US010608395B1

(12) United States Patent
Chen

(10) Patent No.: US 10,608,395 B1
(45) Date of Patent: Mar. 31, 2020

(54) ROTARY SOCKET

(71) Applicant: SHENZHEN ANHAORUIHE ELECTRONICS CO., LTD, Shenzhen (CN)

(72) Inventor: Xinjiao Chen, Shenzhen (CN)

(73) Assignee: SHENZHEN ANHAORUIHE ELECTRONICS CO., LTD, Shenzhen (CN)

( * ) Notice: Subject to any disclaimer, the term of this patent is extended or adjusted under 35 U.S.C. 154(b) by 0 days.

(21) Appl. No.: 16/262,948

(22) Filed: Jan. 31, 2019

(51) Int. Cl.
*H01R 35/04* (2006.01)
*H01R 13/514* (2006.01)
*H01R 13/506* (2006.01)
*H01R 105/00* (2006.01)

(52) U.S. Cl.
CPC ..... *H01R 35/04* (2013.01); *H01R 13/506* (2013.01); *H01R 13/514* (2013.01); *H01R 2105/00* (2013.01)

(58) Field of Classification Search
CPC ..... H01R 35/04; H01R 13/506; H01R 13/514
USPC ..... 439/13
See application file for complete search history.

(56) References Cited

U.S. PATENT DOCUMENTS 5,334,033 A * 8/1994 Milan ..... H01R 13/6666 439/214
6,454,584 B1 * 9/2002 Milan ..... H01R 13/514 439/214
6,750,410 B2 * 6/2004 Lee ..... C08J 9/0004 200/51 R
6,780,038 B1 * 8/2004 Huang ..... H01R 13/113 439/224
6,979,220 B1 * 12/2005 Ray ..... H01R 13/6392 439/346
7,264,514 B2 * 9/2007 Hsu ..... H01R 25/00 439/173
7,497,740 B2 * 3/2009 Mei ..... H01R 13/514 200/51 R
7,771,239 B1 * 8/2010 Hsiao ..... H01R 35/04 439/640
7,874,856 B1 * 1/2011 Schriefer ..... H01R 25/003 439/214
8,157,574 B2 * 4/2012 Hsiao ..... H01R 13/4532 439/131
8,500,492 B2 * 8/2013 Brown ..... H01R 35/04 439/638
8,926,346 B2 * 1/2015 Hsu ..... H01R 13/6675 439/143
9,124,056 B1 * 9/2015 Lewis, Jr. ..... H01R 39/64
9,147,985 B1 * 9/2015 Noriega ..... H01R 25/003
(Continued)

*Primary Examiner* — Tulsidas C Patel
*Assistant Examiner* — Peter G Leigh

(57) ABSTRACT

A rotary socket includes a main case for installing a main control member and a plurality of rotary socket units. The socket unit includes an inner chamber for receiving a partition therein, at least one terminal installed on one side of the partition, and at least one conductive element installed on the other opposite side of the partition and connected to the at least one terminal by a flexible cable. The partition includes a through hole for the cable passing therethrough. The through hole is loosely adapted to the cable so that activity range of the cable can match with rotation of the socket unit, thereby further slightly limiting activity range of the cable so as to avoid affecting connection stability of the cable due to its wide range of activities.

9 Claims, 4 Drawing Sheets

(56) References Cited

U.S. PATENT DOCUMENTS

| | | | | |
|---|---|---|---|---|
| 9,385,489 | B2 * | 7/2016 | Wang | H01R 13/70 |
| 9,735,492 | B2 * | 8/2017 | Shum | H01R 35/04 |
| 9,905,967 | B2 * | 2/2018 | Wang | H01R 24/38 |
| 2006/0094300 | A1 * | 5/2006 | Hsu | H01R 25/00 439/652 |
| 2012/0028505 | A1 * | 2/2012 | Weber | H01R 25/003 439/638 |
| 2016/0149406 | A1 * | 5/2016 | Whitehouse | H01R 25/006 307/12 |
| 2018/0062302 | A1 * | 3/2018 | DeBlois | H01R 9/2408 |
| 2018/0062331 | A1 * | 3/2018 | Finn | H01R 13/514 |

* cited by examiner

ROTARY SOCKET

BACKGROUND

1. Technical Field

The present disclosure generally relates to sockets field, and especially relates to a rotary socket with at least one rotary socket unit.

2. Description of Related Art

A socket, also called a power socket or a switch socket, has one or more socket units therein. In a conventional socket, its socket units are tightly fixed together so that its inserting hole can't be adjusted, thereby it is inconvenient to be used. As a result, rotary sockets gradually appear in the market, and its socket units in this type product can be rotated relative to its main housing. However, when the rotary socket is rotated, its interconnection terminals and conductive bodies inside the socket unit should be matched to each other so as to avoid breakage between them caused by repeated rotations.

SUMMARY

The technical problems to be solved: in view of the shortcomings of the related art, the present disclosure relates to a rotary socket which can provide a through hole to be loosely adapted to the flexible cable so that activity range of the cable can be matched with rotation of the socket unit, thereby further slightly limiting the activity range of the cable so as to avoid affecting connection stability of the cable due to its wide range of activities; and the through hole is slightly larger than radial dimension of the cable to fully satisfy activity demand of the cable, and avoid breakage of the socket unit by repeatedly bending the cable along its engagement direction.

The technical solution adopted for solving technical problems of the present disclosure is:

A rotary socket includes a main case for installing a main control member and a plurality of rotary socket units. The socket unit includes an inner chamber for receiving a partition therein, at least one terminal installed on one side of the partition, and at least one conductive element installed on the other opposite side of the partition and connected to the at least one terminal by a flexible cable. The partition includes a through hole for the cable passing therethrough. The through hole is loosely adapted to the cable so that activity range of the cable can match with rotation of the socket unit.

Wherein the at least one socket unit includes an upper casing, a lower casing connected to the upper casing, and an inner chamber formed between the upper casing and the lower casing, the partition installed on a connection part of the upper and lower casings, the upper casing including at least one inserting slot formed on the upper surface thereof, and a groove formed on its inner portion corresponding to the at least one inserting slot for receiving the terminal therein, the partition further including a post extending towards the groove and supporting on the bottom of the terminal.

Wherein the upper casing is a square housing structure with a lower opening thereof and formed towards the main case, and the lower casing is a semi-circular housing structure with an upper opening thereof and formed far away from the main case.

Wherein the at least one inserting slot includes a live-wire inserting slot, a zero-line inserting slot and a ground-wire inserting hole, and the at least one terminal also includes a live-wire terminal, a zero-line terminal and a ground-wire terminal, a pair of grooves is correspondingly arranged on any one of the inserting slots, and two ends of a concave portion formed on any one of the terminals are embedded in the corresponding pair of grooves.

Wherein a pair of supporting arms is formed on a connecting portion of the terminal for encircling the cable, one supporting arm including a locking groove formed at its outer end thereof, and the other supporting arm also including a tongue formed at its outer end thereof corresponding to the locking groove.

Wherein the plurality of socket units is distributed along their common rotating central lines, and their inner chambers are axially connected as a whole structure to receive the conductive element therein.

Wherein the main case includes a plurality of separating spaces for installing the plurality of socket units, each socket unit respectively includes a sleeve formed on two side surfaces thereof to connect with its inner chamber, the sleeves axially corresponding to each other, and an anti-hook edge radially extending outward from its edge of each sleeve; a circular hole formed on a side cover of each separating space to be adapted to the sleeve, and the inner chamber of each socket unit is connected to each other by the sleeve and the circular hole.

Wherein the main case further includes a main chamber for installing a main control member to connect to the conductive element and connected with each inner chamber of the socket unit.

Wherein the circular hole includes a dummy cover extending inward.

Wherein the main case further includes an exposed USB interface.

The present disclosure provides the advantages as below.

The structure of the present disclosure is provided that the through hole is loosely adapted to the cable so that activity range of the cable can match with rotation of the socket unit, thereby further slightly limiting activity range of the cable so as to avoid affecting connection stability of the cable due to its wide range of activities. Furthermore, the through hole is slightly larger than radial dimension of the cable to fully satisfy activity demand of the cable, and avoid breakage of the socket unit by repeatedly bending the cable along its engagement direction.

BRIEF DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

Figure 1:
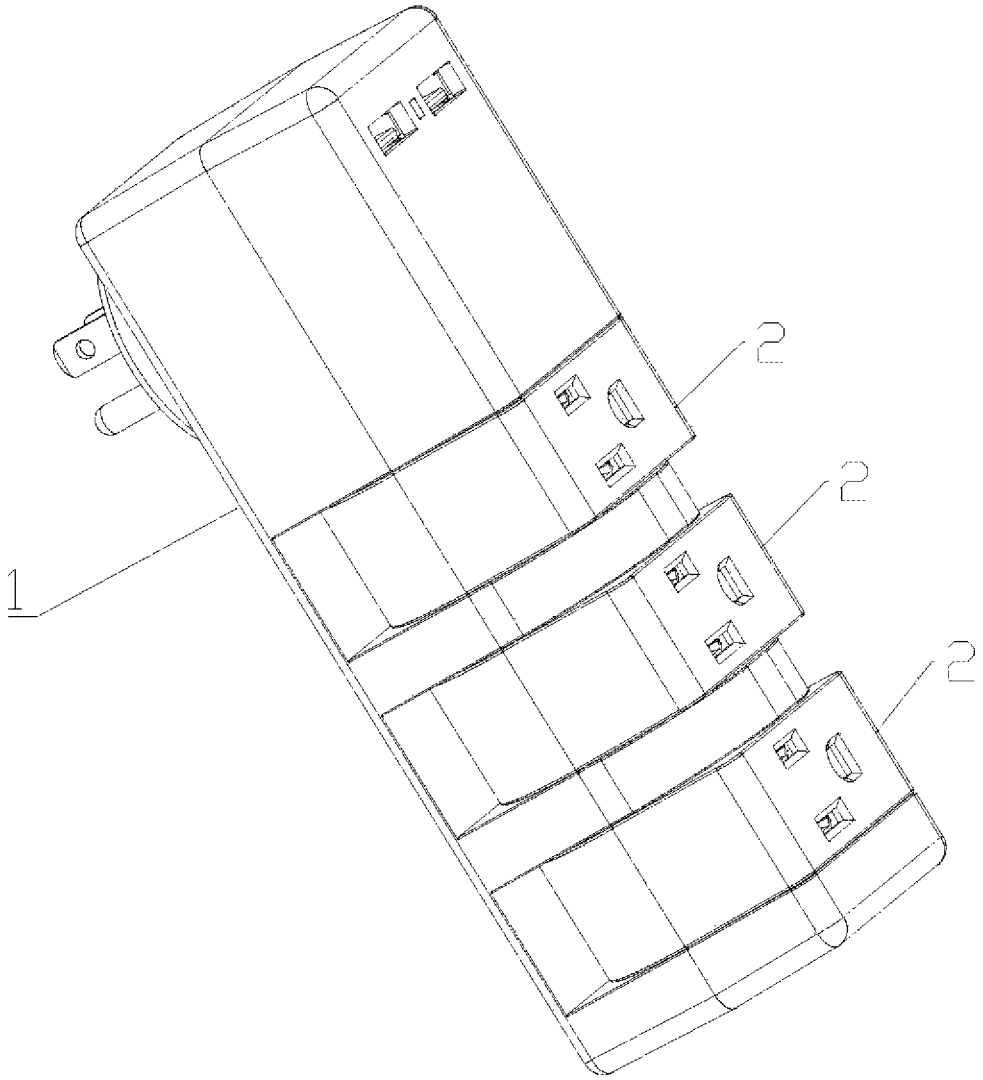
FIG. 1 is a schematic view of the rotary socket in accordance with an exemplary embodiment.

The element labels according to the exemplary embodiment of the present disclosure shown as below:

main case 1, separating space 100, side cover 101, circular hole 102, socket unit 2, inner chamber 20, side surface 200, sleeve 201, anti-hook edge 202, dummy cover 203, partition 21, post 210, conductive element 22, terminal 23, concave portion 230, connecting portion 231, zero-line terminal 232, ground-wire terminal 233, live-wire terminal 234, supporting arm 2311, tongue 2312, locking groove 2313, cable 24, through hole 25, upper casing 26, lower opening 260, inner portion 261, groove 262, lower casing 27, upper opening 270, inserting slot 28, ground-wire inserting slot 280, live-wire inserting slot 281, zero-line inserting slot 282, rotating center line 3, main chamber 4, main control member 40, USB interface 41.

DETAILED DESCRIPTION

The disclosure is illustrated by way of example and not by way of limitation in the figures of the accompanying drawings, in which like reference numerals indicate similar elements.

According to the described exemplary embodiment of the present disclosure, all other embodiments obtained by one of ordinary skill in the related art without the need for a creative labor are within the protection scope of the present disclosure. Unless defined otherwise, the technical terms or scientific terms used for the present disclosure shall be a general meaning commonly understood by those having ordinary skill in the related art to which the present disclosure is applied.

In the description of the present disclosure, it needs to be understood that the terms mentioned below: the terms such as "first" and "second" shown in the specification are only used to describe, but not indicated that the elements of the present disclosure is important or represented the amount of the elements. That is, the features limited by the terms of "first" and "second" may explicitly or implicitly include one or more features. Similar, in the description of the present disclosure, the meaning of the term "one", "a" and "the" don't indicate a quantitative limit, but rather not less than two unless it is specifically illustrated. Furthermore, the terms such as "include", "including", "comprising" and "comprise" and the like means that elements or items in front of such term is intended to cover the elements or objects appeared the list behind the term and its equivalent, without excluding other elements or items. In the description of the present disclosure, except where specifically otherwise illustrated or limited, the terms "install", "connect", "link" and "fix" used herein should be understood in a broad perceive. Such as, the meaning may be tight connection, removable connection, or integrated connection. The meaning may also be mechanical connection, electrical connection, direct connection or indirect connection through intermediaries, or internal connection within two elements. The meaning of the terms used herein may be understood by one of ordinary skill in the related art according to specific conditions of the present disclosure. In addition, the terms such as "upper", "below", "left", and "right", etc, are shown in the specification of the present disclosure. The indicated orientation or position of the terms shown in the detailed description is based on the orientation or position shown in the figures of the accompanying drawings of the present disclosure, which is only to easily simplify the description of the present disclosure, but not indicated that the devices or elements of the present disclosure should have a particular orientation or should be designed and operated in a particular orientation. So the terms illustrated in the detail description are not by way of the limitation of the present disclosure.

A conventional rotary socket is electrically connected to a power supply via a main control member 40. The main control member 40 includes a plug, a printed circuit board (PCB) and a conductive element 22 electrically connected to the PCB. It can be understood that the conductive element 22 can also be a PCB and terminals of each socket unit 2 are electrically connected with the conductive element 22. When rotating the socket unit 2, in order to ensure that the terminal and its inserting slot are always corresponded to each other, the terminal should be synchronously shifted. A connecting portion between the terminal and the conductive element 22 should be adapted to the above feature, otherwise the connecting portion can be damaged so that the socket unit 2 can't be used.

Figure 2:
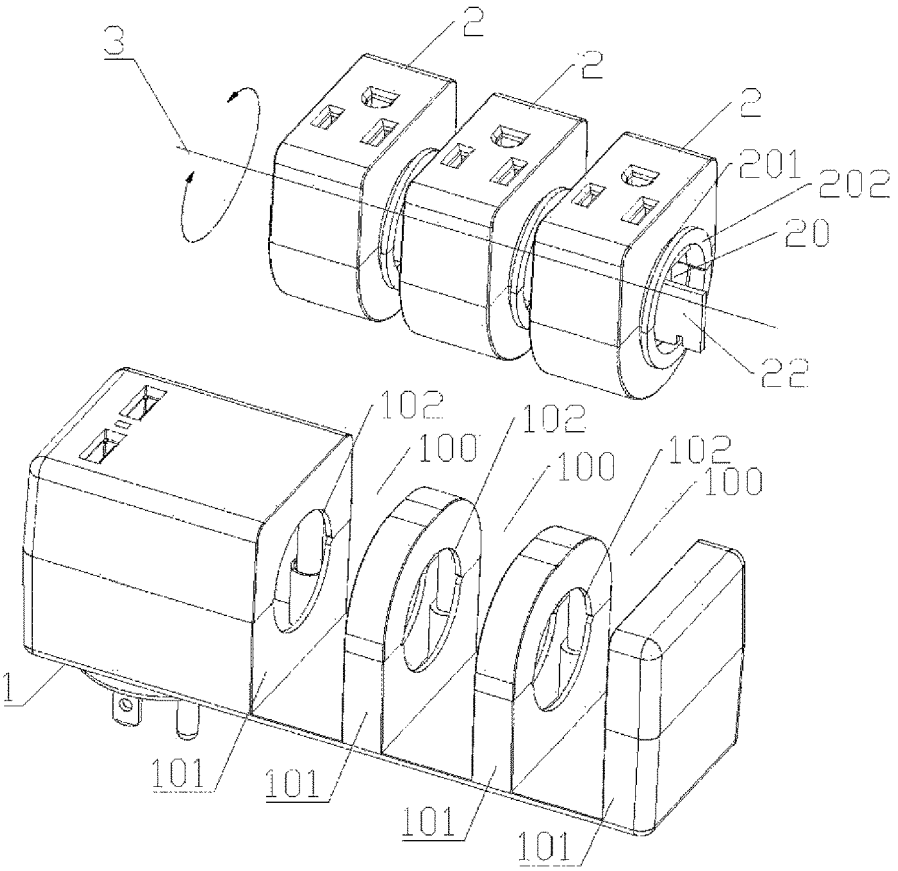
FIG. 2 is an exploded, schematic view of the rotary socket of FIG. 1.
Figure 3:
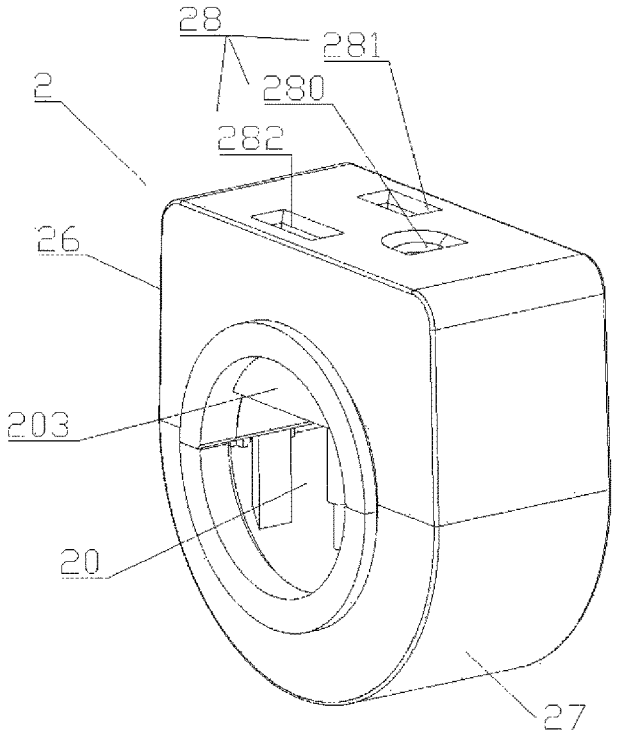
FIG. 3 is a schematic view of a socket unit of the rotary socket of FIG. 1.
Figure 4:
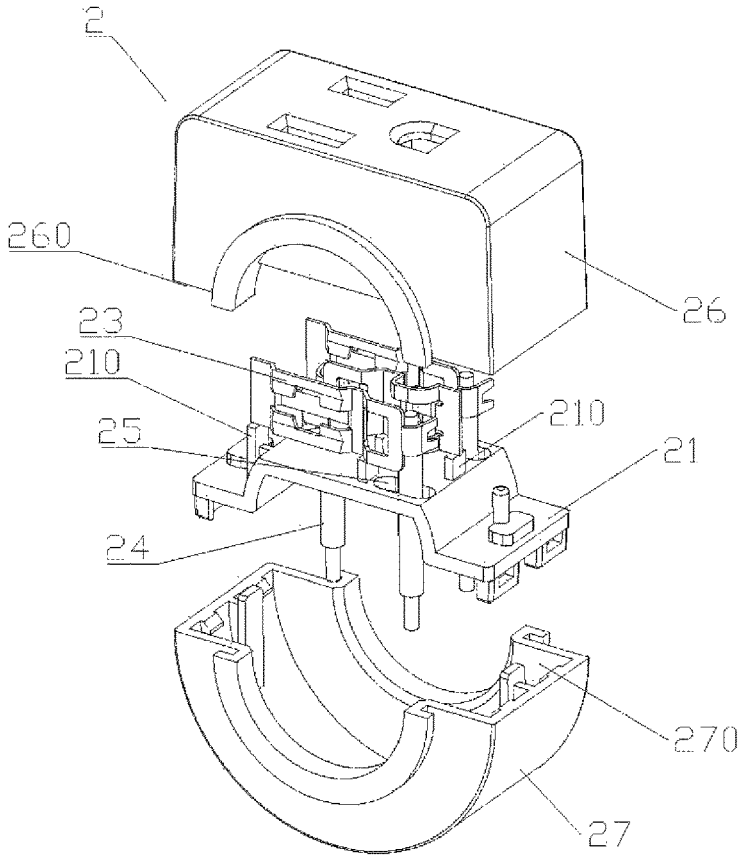
FIG. 4 is an exploded, schematic view of the socket unit of the rotary socket of FIG. 1.
Figure 5:
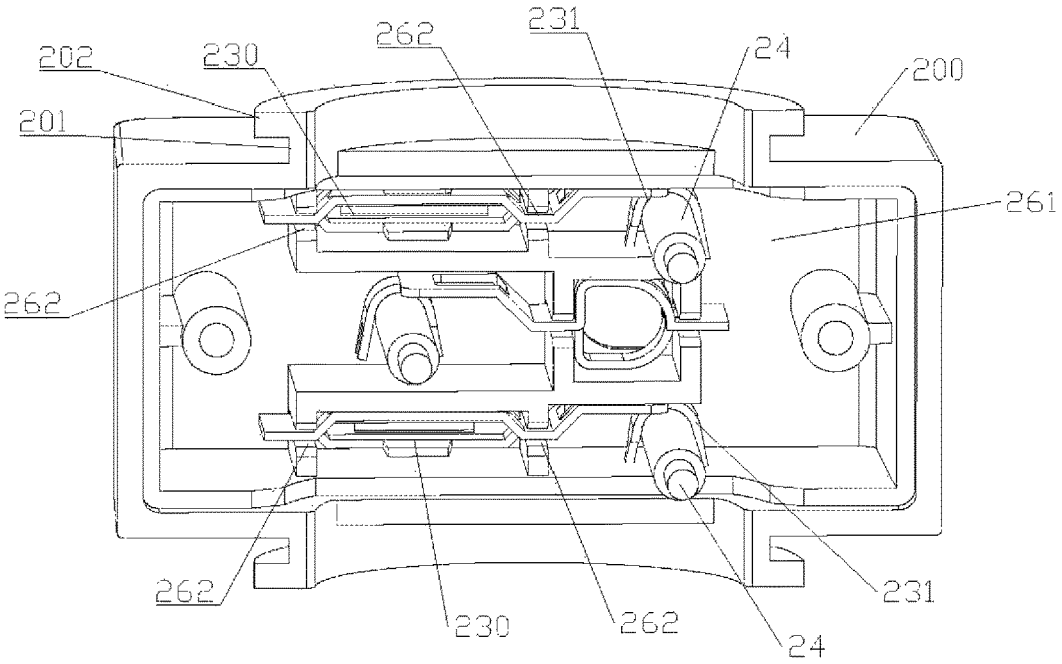
FIG. 5 is an assembly schematic view of a terminal and an upper casing of the rotary socket of FIG. 1.
Figure 6:
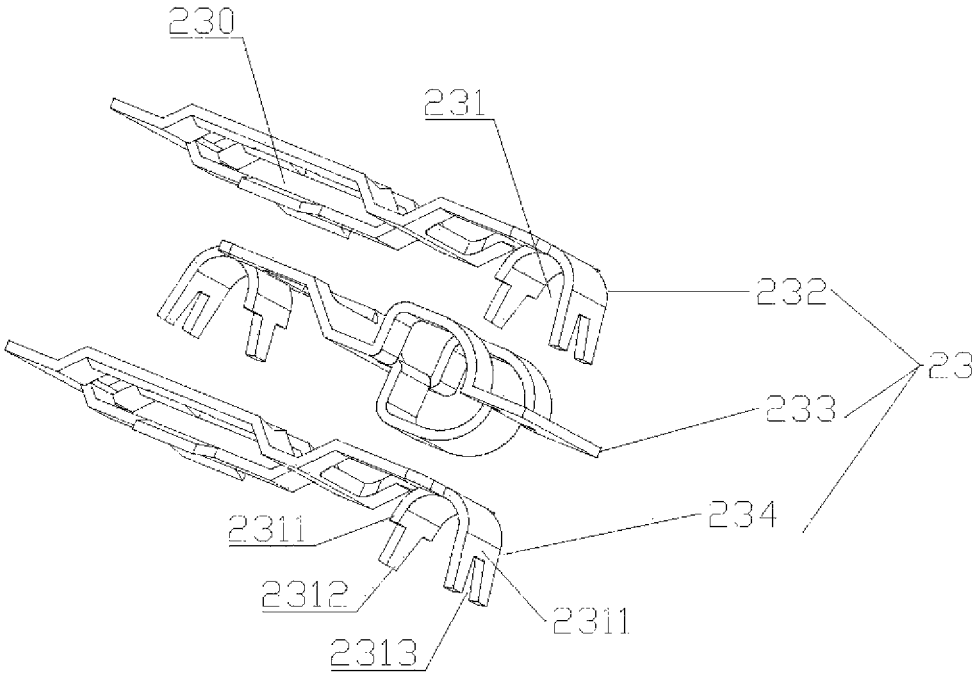
FIG. 6 is a schematic view of the terminal of the rotary socket of FIG. 1.
Figure 7:
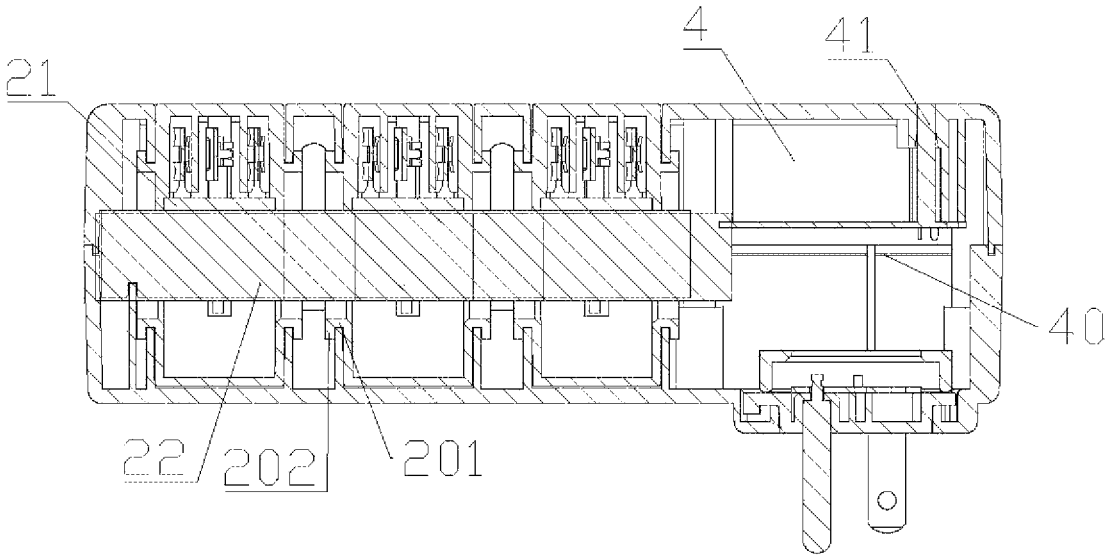
FIG. 7 is an exploded, schematic view of the rotary socket of FIG. 1.

Referring to FIGS. 1-7, the rotary socket in accordance with an exemplary embodiment of the present disclosure includes a main case 1 for installing the main control member 40 and a plurality of rotary socket units 2. The socket unit 2 includes an inner chamber 20 for receiving a partition 21 therein, at least one terminal 23 installed on one side of the partition 21, and at least one conductive element 22 installed on the other opposite side of the partition 21 and connected to the at least one terminal 23 by a flexible cable 24. The partition 21 includes a through hole 25 for the cable 24 passing therethrough. The through hole 25 is loosely adapted to the cable 24 so that activity range of the cable 24 can match with rotation of the socket unit 2.

The cable 24 is made of flexible material so that the socket unit 2 can have a good fit during its rotation. The through hole 25 is loosely adapted to the cable 24 so that activity range of the cable 24 can match with rotation of the socket unit 2, thereby further slightly limiting activity range of the cable 24 so as to avoid affecting connection stability of the cable 24 due to its wide range of activities. The through hole 25 is slightly larger than radial dimension of the cable 24, generally 1.2 to 3 times larger. Such arrangement above can fully satisfy activity demand of the cable 24, and avoid breakage of the socket unit 2 by repeatedly bending the cable 24 along its engagement direction.

In some exemplary embodiments of the present disclosure, the at least one socket unit 2 includes an upper casing 26, a lower casing 27 connected to the upper casing 26, and an inner chamber 20 formed between the upper casing 26 and the lower casing 27. The partition 21 is installed on a connection part of the upper and lower casings 26, 27. The assembly of the upper casing 26, the lower casing 27 and the partition 21 can be realized by a common clasp structure. The upper casing 26 includes at least one inserting slot 28 formed on the upper surface thereof, and a groove 262 formed on its inner portion 261 corresponding to the at least one inserting slot 28 for receiving the terminal 23 therein. The partition 21 further includes a post 210 extending towards the groove 262 and supporting on the bottom of the terminal 23. The terminal 23 is installed in the groove 262 so that it is limited by the top of the upper casing 26 and the post 210 from the top and bottom directions, so as to ensure the stable position of the terminal 23.

The upper casing 26 is a square housing structure with a lower opening 260 thereof and formed towards the main case 1, and the lower casing 27 is a semi-circular housing structure with an upper opening 270 thereof and formed far away from the main case 1. The semicircular lower casing 27 is arranged near the main case 1 to meet requirements of rotation action of the socket unit 2, while, the upper casing 26, which is relatively far away from the main case 1 and set as a square housing structure, includes the at least one inserting slot 28 to be also convenient for rotation operation, thereby hand isn't easy to be slipped.

The at least one inserting slot 28 includes a live-wire inserting slot 281, a zero-line inserting slot 282 and a ground-wire inserting hole 280, and the at least one terminal 23 also includes a live-wire terminal 234, a zero-line terminal 232 and a ground-wire terminal 233. A pair of grooves 262 is correspondingly arranged on any one of the inserting slots 28, and two ends of a concave portion 230 formed on any one of the terminals 23 are embedded in the corresponding pair of grooves 262. The groove 262 is arranged enough to ensure a stable correspondence between the inserting slot 28 and the terminal 23. In this way, it can avoid that the terminal 23 is offset after frequent insertion and unplugging and the plug is difficult to electrically connect to the concave portion 230 of the terminal 23 via the inserting slot 28.

The connection between the cable 24 and the terminal 23 can be obtained by a welding way. However, errors in the welding process can affect connection stability between them, so the terminal 23 can be provided with a corresponding structure to strengthen its connection with the cable 24. A pair of supporting arms 2311 is formed on a connecting portion 231 of the terminal 23 for encircling the cable 24, one supporting arm 2311 includes a locking groove 2313 formed at its outer end thereof, and the other supporting arm 2311 also includes a tongue 2312 formed at its outer end thereof corresponding to the locking groove 2311. During assembly, the cable 24 is first placed between the pair of supporting arms 2311, and then the pair of supporting arms 2311 is wrapped around the cable 24, finally, the cable 24 is fixed with the terminal 23 by the welding way. In this way, the connection between the pair of supporting arms 2311 and the cable 24 is obtained by the locking groove 2313 and the tongue 2312 so that an offset of the mating position of the two supporting arms 2311 can be avoided, thereby the terminal 23 and the cable 24 can be held together in a stable way.

The amount of the socket unit 2 can't be limited, generally there are two to five socket units 2 set in a single socket. The plurality of socket units 2 is distributed along their common rotating central lines (not an actual structure, only used as a reference to describe a layout of the socket unit), and the inner chambers 20 of each socket unit 2 are connected axially as a whole structure to receive the conductive element 22 therein. The integral inner chamber 20 is conducive to simplifying the installation of the conductive element 22 and avoiding the need to independently install the conductive element 22 for each socket unit 2. For example, an integral PCB can be placed in the inner chambers 20, and the terminals 23 in each socket unit 2 can be electrically connected to the PCB through a corresponding cable 24.

The main case 1 includes a plurality of separating spaces 100 for installing the plurality of socket units 2. Each socket unit 2 respectively includes a sleeve 201 formed on two side surfaces 200 thereof to connect with its inner chamber 20, the sleeves 201 axially corresponding to each other, and an anti-hook edge 202 radially extending outward from an edge of each sleeve 201. A circular hole 102 is formed on a side cover 101 of each separating space 100 to be adapted to the sleeve 201, and the inner chamber 20 of each socket unit 2 is connected to each other by the sleeve 201 and the circular hole 102. The anti-hook edge 202 clamps on edges of the circular hole 102 in the side cover 101 to avoid separation from the circular hole 102 due to its escape. A rotary function of the socket unit 2 can be achieved by matching the sleeve 201 with the circular hole 102, and the axial connection of each inner chamber 20 can be also achieved by matching the sleeve 201 with the circular hole 102, thereby two functions can be obtained by a set of structural setting so as to simplify the overall structure. At the same time, the circular hole 102 includes a dummy cover 203 extending inward for stabilizing the position of the conductive element 22 to avoid any random deflection.

The main control member 40 can be installed in the main chamber 4 of the main case 1, and the main chamber 4 is connected to the inner chamber 20 via the circular hole 102 of the separating space 100 so that the main control member 40 can be electrically connected to the conductive element 22. Furthermore, the main chamber 4 further includes an exposed USB interface 41 to enhance the applicability of the socket.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A rotary socket comprising:

a main case for installing a main control member and a plurality of rotary socket units;

the socket unit comprising an inner chamber for receiving a partition therein, at least one terminal installed on one side of the partition, and at least one conductive element installed on the other opposite side of the partition and connected to the at least one terminal by a flexible cable;

the partition comprising a through hole for the cable passing therethrough; and wherein the through hole is adapted to the cable so that activity range of the cable can match with rotation of the socket unit; wherein the at least one socket unit comprises an upper casing, a lower casing connected to the upper casing, and the inner chamber formed between the upper casing and the lower casing, the partition installed on a connection part of the upper and lower casings, the upper casing comprising at least one inserting slot formed on the upper surface thereof, and a groove formed on its inner portion corresponding to the at least one inserting slot for receiving the terminal therein, the partition further comprising a post extending towards the groove and supporting on the bottom of the terminal.

2. The rotary socket as claimed in claim 1, wherein the upper casing is a square housing structure with a lower opening thereof and formed towards the main case, and the lower casing is a semi-circular housing structure with an upper opening thereof and formed far away from the main case.

3. The rotary socket as claimed in claim 1, wherein the at least one inserting slot comprises a live-wire inserting slot, a zero-line inserting slot and a ground-wire inserting hole, and the at least one terminal also comprises a live-wire terminal, a zero-line terminal and a ground-wire terminal, a pair of grooves is correspondingly arranged on any one of the inserting slots, and two ends of a concave portion formed on any one of the terminals are embedded in the corresponding pair of grooves.

4. The rotary socket as claimed in claim 3, wherein a pair of supporting arms is formed on a connecting portion of the terminal for encircling the cable, one supporting arm comprising a locking groove formed at its outer end thereof, and the other supporting arm also comprising a tongue formed at its outer end thereof corresponding to the locking groove.

5. The rotary socket as claimed in claim 1, wherein the plurality of socket units is distributed along their common rotating central lines, and their inner chambers are axially connected as a whole structure to receive the conductive element therein.

6. The rotary socket as claimed in claim 5, wherein the main case comprises a plurality of separating spaces for installing the plurality of socket units, each socket unit respectively comprising a sleeve formed on two side surfaces thereof to connect with its inner chamber, the sleeves axially corresponding to each other, and an anti-hook edge radially extending outward from an edge of each sleeve; a circular hole formed on a side cover of each separating space to be adapted to the sleeve, and the inner chamber of each socket unit connected to each other by the sleeve and the circular hole.

7. The rotary socket as claimed in claim 6, wherein the main case further comprises a main chamber for installing a main control member to connect to the conductive element, and connected with each inner chamber of the socket unit.

8. The rotary socket as claimed in claim 7, wherein the circular hole comprises a dummy cover extending towards its inner portion.

9. The rotary socket as claimed in claim 8, wherein the main case further comprises an exposed USB interface.

* * * * *